US009486023B1

(12) United States Patent
Kim et al.

(10) Patent No.: US 9,486,023 B1
(45) Date of Patent: Nov. 8, 2016

(54) ARTIFICIAL HAIR APPARATUS AND METHOD

(71) Applicant: SHAKE-N-GO FASHION INC., Port Washington, NY (US)

(72) Inventors: James K. Kim, Manhasset, NY (US); Peter Ough, Bayside, NY (US); Hye Sun Kim, Port Washington, NY (US)

(73) Assignee: SHAKE-N-GO FASHION, INC., Port Washington, NY (US)

( * ) Notice: Subject to any disclaimer, the term of this patent is extended or adjusted under 35 U.S.C. 154(b) by 0 days.

(21) Appl. No.: 14/829,328

(22) Filed: Aug. 18, 2015

(51) Int. Cl.
*A41G 3/00* (2006.01)

(52) U.S. Cl.
CPC ..... *A41G 3/005* (2013.01)

(58) Field of Classification Search
CPC .. A41G 3/0041; A41G 3/005; A41G 3/0058; A41G 5/00; A41G 5/006; A41G 5/004
USPC ..... 132/53, 54
See application file for complete search history.

(56) References Cited

U.S. PATENT DOCUMENTS 1,545,881 A * 7/1925 Cohen ..... A41G 3/0041 132/274
1,740,764 A * 12/1929 Bong ..... A41G 3/00 132/201
2,233,100 A * 2/1941 Jevnikar ..... A41G 3/00 132/53
2,438,005 A * 3/1948 Goldman ..... A41G 3/00 132/53
2,736,325 A * 2/1956 Dvorzsak ..... A41G 5/0006 132/53
3,645,279 A * 2/1972 Imre ..... A41G 3/00 132/53
3,662,768 A 5/1972 Klugmann
4,517,999 A 5/1985 Finamore
7,537,014 B1 * 5/2009 Yoo ..... A41G 3/0058 132/201
8,042,553 B2 10/2011 Paris
9,027,568 B2 5/2015 Lee
2004/0168696 A1 * 9/2004 Cox ..... A41G 3/0041 132/54
2004/0211436 A1 10/2004 Knight
2007/0044814 A1 * 3/2007 Belo ..... A41G 3/00 132/53
2009/0165810 A1 7/2009 Sotokawa et al.
2009/0199861 A1 * 8/2009 Paris ..... A41G 3/0075 132/201
2013/0098380 A1 * 4/2013 Kim ..... A41G 5/006 132/53
2014/0251362 A1 * 9/2014 Lee ..... A41G 3/00 132/201
2014/0283862 A1 * 9/2014 Miyatake ..... A41G 3/0041 132/53
2015/0327609 A1 * 11/2015 Suh ..... A41G 3/0075 132/201

* cited by examiner

*Primary Examiner* — Tatiana Nobrega
(74) *Attorney, Agent, or Firm* — Cowan, Liebowitz & Latman, P.C.; Mark Montague; Brian R. Volk

(57) ABSTRACT

An artificial hair apparatus comprises: a front region comprising an inner front surface, an outer front surface, a first mesh section and a second mesh section, the first mesh section comprising a first hair parting channel comprising a first predetermined length and a second hair parting channel comprising a second predetermined length, the first hair parting channel and the second hair parting channel protruding into the second mesh section such that the first predetermined length is different from the second predetermined length; a top region adjacent to the front region comprising an inner top surface and an outer top surface; a rear region adjacent to the top region comprising an inner rear surface and an outer rear surface; and a plurality of side regions adjacent to each of the front region, the top region and the rear region comprising an inner side surface and an outer side surface.

10 Claims, 7 Drawing Sheets

ARTIFICIAL HAIR APPARATUS AND METHOD

BACKGROUND OF THE INVENTION

1. Field of the Invention

The present invention relates generally to artificial hair, and more particularly, to an artificial hair apparatus and method of manufacturing the artificial hair apparatus.

2. Description of the Related Art

Wigs are used by people to enhance their appearance and to conceal their natural hair. Wigs generally include multiple strands of hair attached to a cap to form a unit that can be secured to an user's scalp. Hair weaves and hair extensions are also used by people to either conceal or supplement their natural hair. In some cases, people use wigs when they are experiencing baldness or thinning of their natural hair. For those experiencing baldness or thinning of natural hair, use of wigs provides an alternative to use of potentially dangerous hair growth drugs or chemicals, or uncomfortable hair plugs. In other cases, people use wigs for temporary purposes when they are undergoing medical treatments that result in loss of their hair, such as chemotherapy.

Wigs are also used to provide a user with an alternative hair color in order to improve their appearance. Furthermore, wigs can be used by people to present an alternative texture to their own hair, such as changing their hair from straight to curly. Just as many people enjoy accessorizing their wardrobe, people who wear wigs enjoy changing and enhancing their appearance.

SUMMARY OF THE INVENTION

Accordingly, an embodiment provides an artificial hair apparatus. The artificial hair apparatus comprises: a front region comprising an inner front surface, an outer front surface, a first mesh section and a second mesh section, the first mesh section comprising a first hair parting channel comprising a first predetermined length and a second hair parting channel comprising a second predetermined length, the first hair parting channel and the second hair parting channel protruding into the second mesh section such that the first predetermined length is different from the second predetermined length; a top region adjacent to the front region comprising an inner top surface and an outer top surface; a rear region adjacent to the top region comprising an inner rear surface and an outer rear surface; a plurality of side regions adjacent to each of the front region, the top region and the rear region comprising an inner side surface and an outer side surface; and a weft of artificial hair extending through at least a portion of one of the front region, the top region, the rear region, and the side regions.

According to further embodiments: the weft of artificial hair extends through at least a portion of the front region and at least a portion of one of the top region and the side regions; a filament comprises a first filament end and a second filament end, the first filament end being coupled to the front region and the second filament end being coupled to the rear region; the weft of artificial hair is coupled to the filament in at least one of the front region, the top region, the rear region, and the side regions; the first mesh section comprises a third hair parting channel, the third hair parting channel comprising a third predetermined length protruding into the second mesh section such that the third predetermined length is different from the second predetermined length; the second hair parting channel is disposed between the first hair parting channel and the third hair parting channel; the first predetermined length and the third predetermined length are greater than the second predetermined length; the first predetermined length and the third predetermined length are less than the second predetermined length; the inner front surface of the front region directly contacts a user's scalp; there is no liner between the inner front surface, the inner top surface, the inner rear surface and the inner side surfaces and a user's scalp; and at least a portion of artificial hair coupled the second hair parting channel overlaps the first hair parting channel and the third hair parting channel when the artificial hair coupled to the second hair parting channel is parted.

An additional embodiment provides an artificial hair apparatus comprising: a front region comprising a first mesh section and a second mesh section, the first mesh section comprising a first hair parting channel, a second hair parting channel and a third hair parting channel, each of the first hair parting channel, the second hair parting channel and the third hair parting channel protruding into the second mesh section such that at least a portion of the second mesh section is disposed between each of the first hair parting channel and the second hair parting channel, and the second hair parting channel and the third hair parting channel; the first mesh section comprising a plurality of first artificial hair coupled to a surface thereof at a first predetermined density; and the second mesh section comprising a plurality of second artificial hair coupled to a surface thereof at a second predetermined density that is less than the first predetermined density.

According to further embodiments: the first artificial hair and the second artificial hair are coupled directly to outer surfaces of the first hair parting channel, the second hair parting channel and the third hair parting channel; at least a portion of the second hair parting channel is disposed between the first hair parting channel and the third hair parting channel; a top region is coupled to the front region, a rear region coupled to the top region, a plurality of side regions coupled to each of the front region, the top region and the rear region, and a plurality of wefts of artificial hair extending through at least a portion of one of front region, the top region, the rear region and the side regions; and the first artificial hair coupled to the second hair parting channel overlaps the first artificial hair coupled to the first hair parting channel and the third hair parting channel.

An additional embodiment provides: an artificial hair apparatus comprising: a front region comprising an inner front surface, an outer front surface, a first mesh section and a second mesh section, the first mesh section comprising a first hair parting channel, a second hair parting channel, and a third hair parting channel; a top region adjacent to the front region comprising an inner top surface and an outer top surface; a rear region adjacent to the top region comprising an inner rear surface and an outer rear surface; a plurality of side regions adjacent to each of the front region, the top region and the rear region comprising an inner side surface and an outer side surface; and a weft of artificial hair extending through at least a portion of the front region and at least a portion of one of the top region and the side regions.

According to further embodiments: the weft of artificial hair is coupled to the first mesh section; the weft of artificial hair extends through at least a portion of the top region and the side regions; and the weft of artificial hair is coupled to the first mesh section in an area corresponding to a user's temple.

BRIEF DESCRIPTION OF THE DRAWINGS

The above and other aspects, features and advantages of certain embodiments will be more apparent from the following detailed description taken in conjunction with the accompanying drawings, in which.

DETAILED DESCRIPTION OF THE PRESENT INVENTION

The following detailed description of certain embodiments will be made in reference to the accompanying drawings. In the detailed description, explanation about related functions or constructions known in the art are omitted for the sake of clearness in understanding the concept of the invention, to avoid obscuring the invention with unnecessary detail.

As illustrated and described herein, an artificial hair apparatus 100 is a wig that covers a user's natural hair or scalp. The artificial hair apparatus 100 is embodied in various hair textures, such as curly, straight, crimped, wavy, and combinations thereof. The artificial hair apparatus 100 includes multiple parting areas so that a user may optionally part their hair down the center, left side and right side, providing a user with a natural and fashionable appearance. Also, the artificial hair apparatus 100 includes various components designed to hold the artificial hair apparatus 100 to a user's scalp in a comfortable and natural-appearing manner. The phrase "artificial hair," as used herein, refers to synthetic hair products as well as human hair or animal hair and combinations thereof and may be embodied in various traditional hair colors, such as black, brown, blonde, and red, as well as non-traditional hair colors, such as blue, green, and purple, and combinations thereof, including individual strands of hair having two or more colors.

Figure 1:
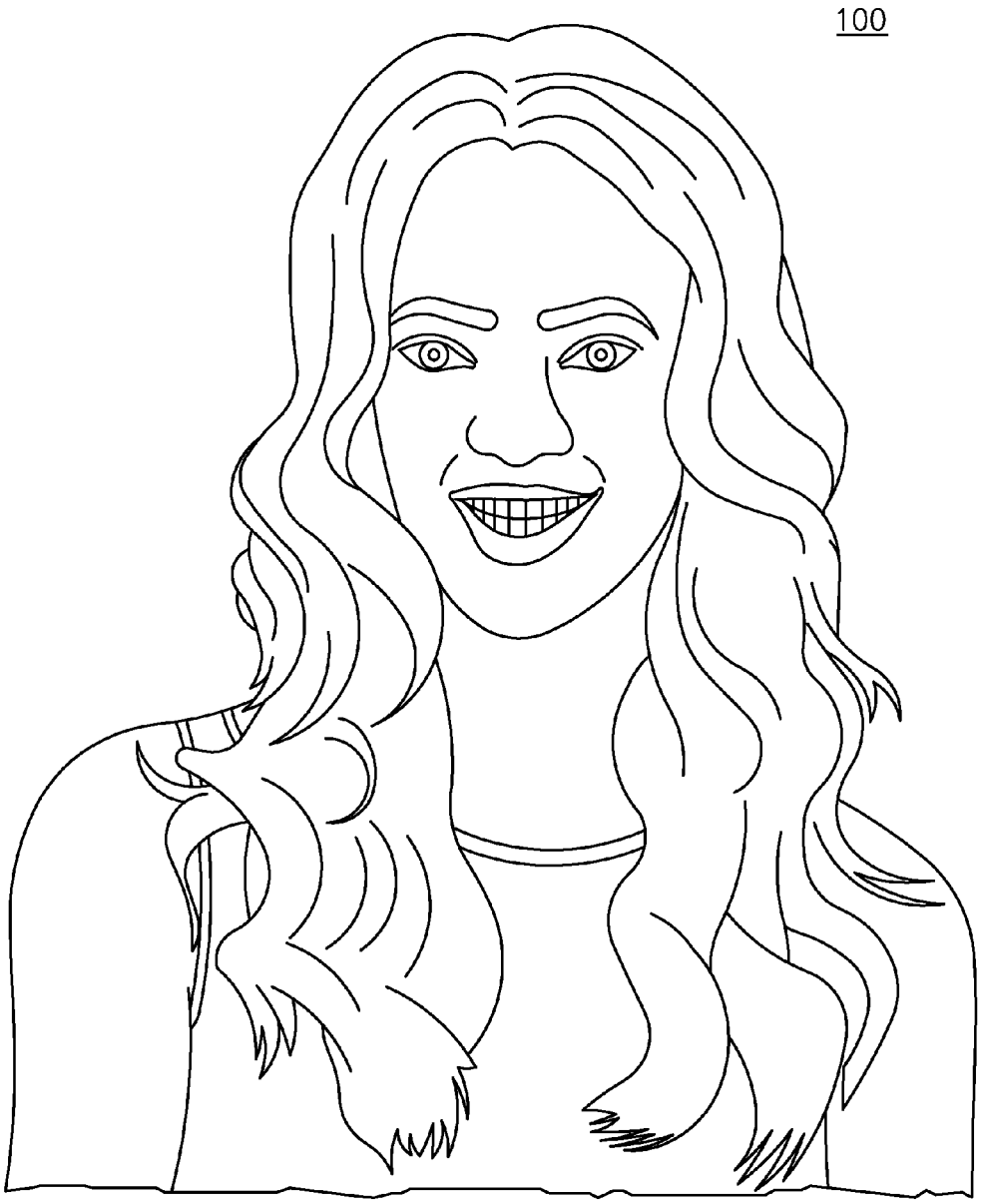
FIG. 1 illustrates a front view of an artificial hair apparatus with artificial hair parted down the center of a user's scalp.
Figure 2:
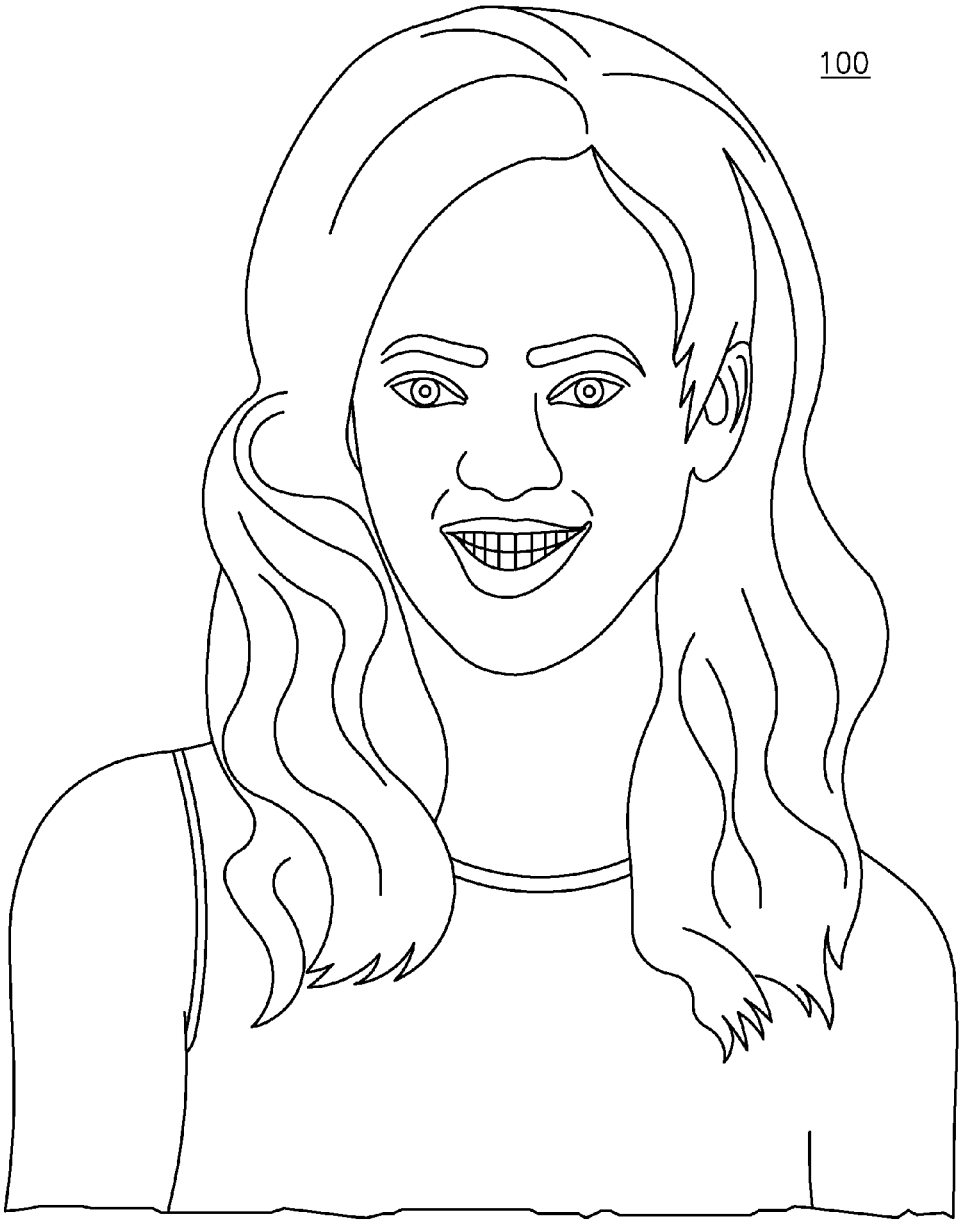
FIG. 2 illustrates a front view of the artificial hair apparatus with artificial hair parted down the left side of a user's scalp.
Figure 3:
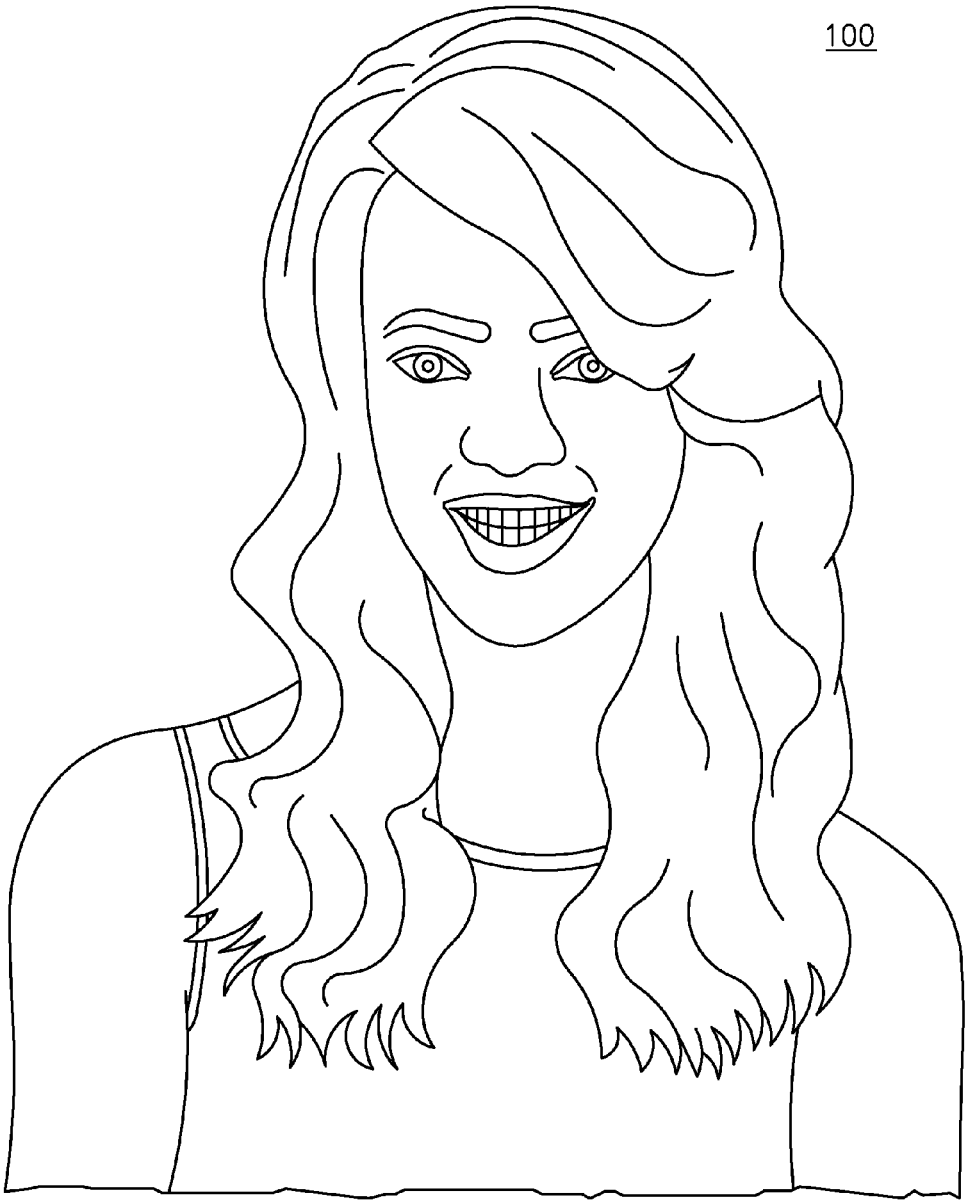
FIG. 3 illustrates a front view of the artificial hair apparatus with artificial hair parted down the right side of a user's scalp.

FIGS. 1-3 illustrate a front view of an outer surface of the artificial hair apparatus 100 with artificial hair parted down the center, left side, and right side, respectively, of a user's scalp. As further described herein, the artificial hair apparatus 100 includes multiple hair parting channels configured such that artificial hair disposed thereon may be parted, e.g., separated to the left and to the right, along the length of each parting channel. With multiple parting channels, a user of the artificial hair apparatus 100 is able to arrange the artificial hair in various styles according to their preference.

Figure 4:
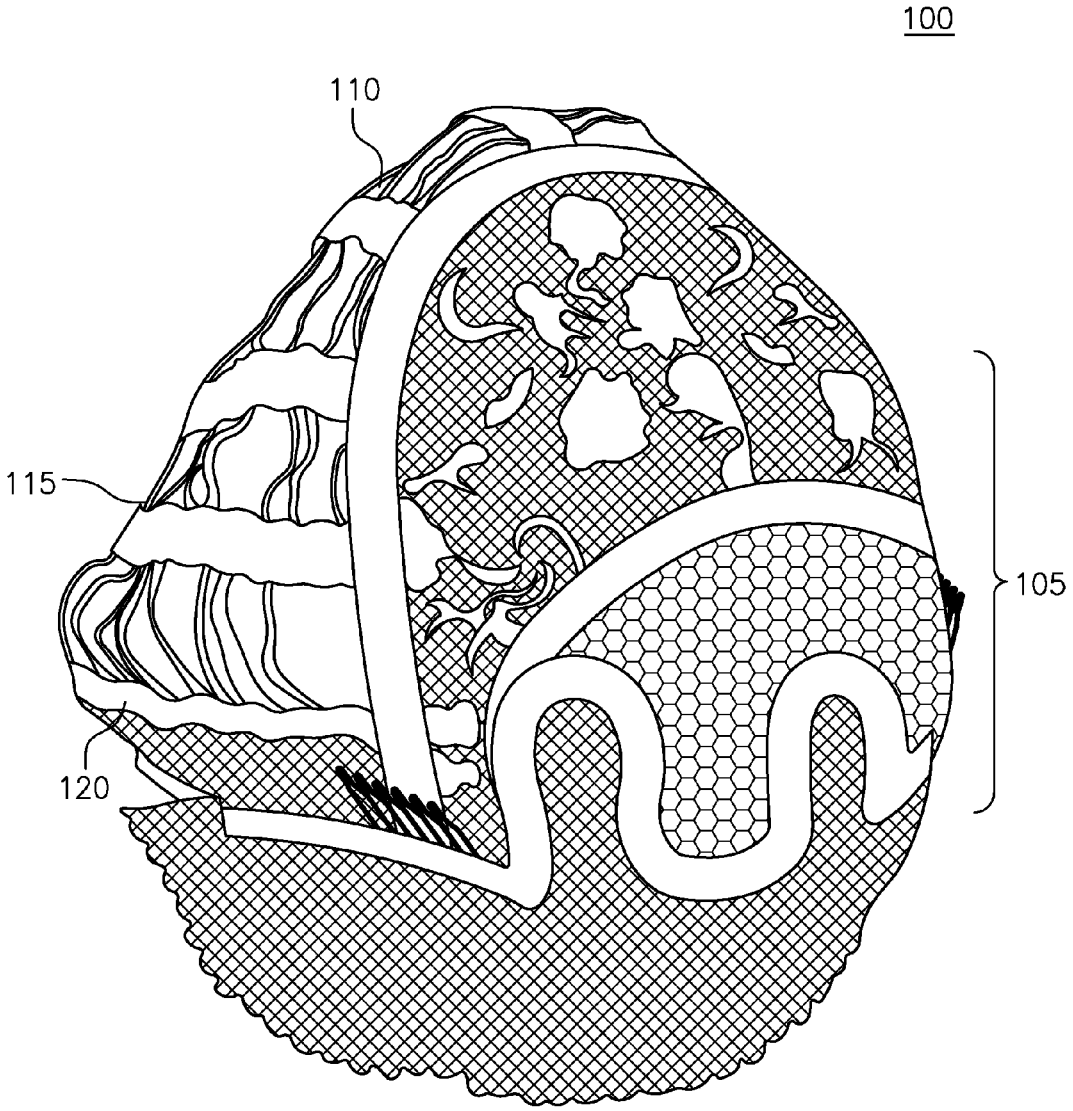
FIG. 4 illustrates a perspective view of an outer surface of the artificial hair apparatus.

FIG. 4 illustrates a perspective view of the artificial hair apparatus 100. Artificial hair disposed on the outer surface has been removed for illustrative purposes. The artificial hair apparatus 100 includes a front region 105, a top region 110, a rear region 115, a side region 120, and a circumferential edge region 122. The front region 105 corresponds to the front of a user's scalp and borders the user's forehead. The top region 110 corresponds to the top of a user's scalp. The rear region 115 corresponds to the rear of a user's scalp and borders the user's neck. The side region 120 corresponds to the sides of a user's scalp, near the user's ears.

Figure 5:
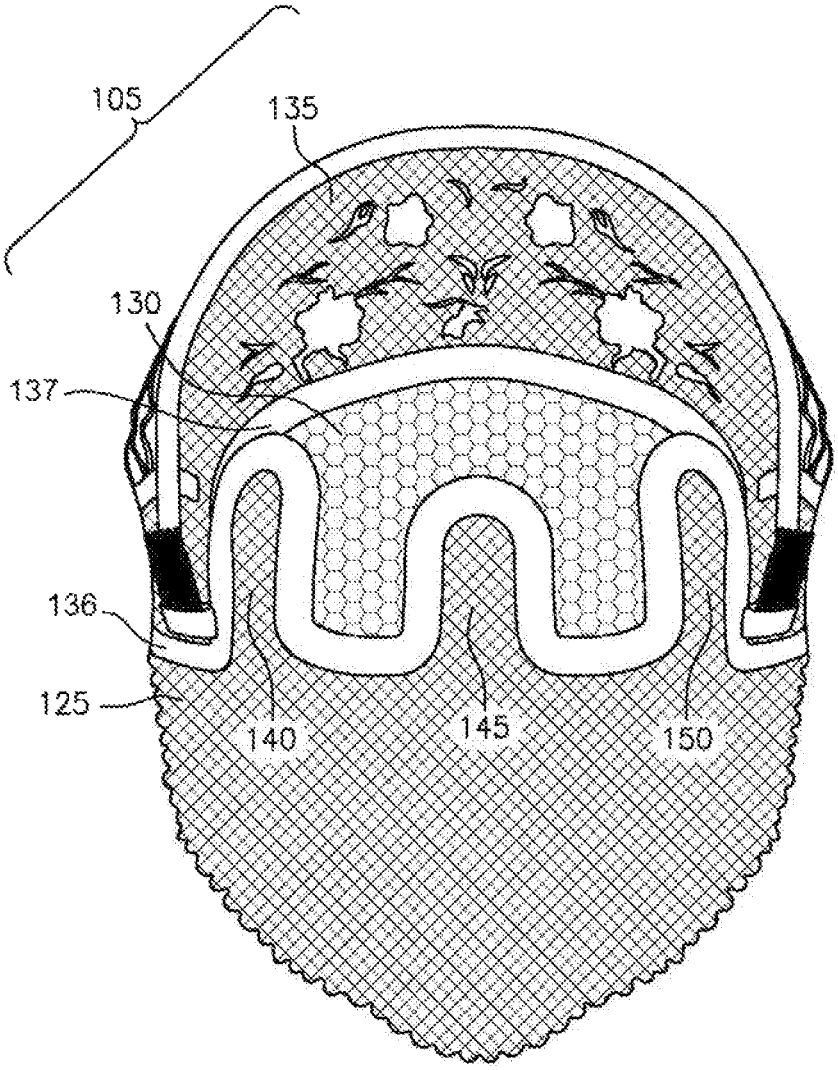
FIG. 5 illustrates a front view of the outer surface of the artificial hair apparatus.

FIG. 5 illustrates a front view of the artificial hair apparatus 100. Artificial hair disposed on the outer surface has been removed for illustrative purposes. The front region 105 includes an inner front surface, an outer front surface, a first mesh section 125, a second mesh section 130 and a third mesh section 135. The first mesh section 125 is attached to the second mesh section along a first connecting element 136 and the second mesh section is attached to the third mesh section along a second connecting element 137. The first mesh section 125 includes a first hair parting channel 140, a second hair parting channel 145 and a third hair parting channel 150. The hair parting channels have a generally U-shape configuration which opens anteriorly and defines an apex at posterior positions proximate the second mesh section. The first connecting element 136 having an undulating central portion between the first and second mesh section and having opposing linear lateral portions extending posteriorly from opposing sides of the undulating central portion. The second connecting element 137 has opposing first and second ends coupled to the first connecting element at portions proximate the apex and lateral-most portions of the first and third hair parting channels. The inner front surface of the front region 105 directly contacts a user's scalp when the artificial hair apparatus 100 is worn by the user. The first mesh section 125 is constructed of hand-tied nylon, silk, or cotton lace, or other suitable materials and blends thereof. The first hair parting channel 140 corresponds to the right side of a user's scalp. The second hair parting channel 145 corresponds to the center of a user's scalp. The third hair parting channel 150 corresponds to the left side of a user's scalp. At least a portion of the second hair parting channel 145 is disposed between the first hair parting channel 140 and the third hair parting channel 150.

When artificial hair is parted down one or more of the first hair parting channel 140, the second hair parting channel 145, and the third hair parting channel 150, the outer surface is partially visible, though, due to the material used to construct the first mesh section 125, the portion of the outer surface appears natural and it is not apparent to an observer that the user is wearing a wig. When artificial hair coupled to the second hair parting channel 145 is parted, at least a portion of the artificial hair coupled the second hair parting channel 145 overlaps the first hair parting channel 140 and the third hair parting channel 150. When artificial hair coupled to the first hair parting channel 140 is parted, at least a portion of the artificial hair coupled the first hair parting channel 140 overlaps the second hair parting channel 145.

The first mesh section 125, including the first hair parting channel 140, the second hair parting channel 145, and the third hair parting channel 150, includes first artificial hair coupled to an outer surface thereof. The first artificial hair is disposed on the surface of the first mesh section 125 at a first predetermined density. The second mesh section 130 includes second artificial hair coupled to an outer surface thereof. The second artificial hair is disposed on the surface of the second mesh section 130 at a second predetermined density. The second predetermined density of artificial hair may be less than the first predetermined density of artificial hair. The density of artificial hair refers to the amount of artificial hair coupled to a surface per unit of surface area.

The first hair parting channel 140, the second hair parting channel 145 and the third hair parting channel 150 each protrude into the second mesh section 130 a first predetermined length, a second predetermined length and a third predetermined length, respectively. The first predetermined length of the first hair parting channel 140 may be different from the second predetermined length of the second hair parting channel 145. The third predetermined length of the third hair parting channel 150 may different from the second predetermined length of the second hair parting channel 145. The first predetermined length of the first hair parting channel 140 and the third predetermined length of the third hair parting channel 150 may be greater than the second predetermined length of the second hair parting channel 145. The first predetermined length of the first hair parting channel 140 and the third predetermined length of the third hair parting channel 150 may be less than the second predetermined length of the second hair parting channel 145.

The second mesh section 130 is constructed of hand-tied nylon, silk, or cotton lace, or other suitable material. The second mesh section 130 may be configured in a honeycomb pattern or any other suitable pattern including interlocking shapes, such as circles, triangles, squares, pentagons, heptagons, octagons, and combinations thereof. At least a portion of the second mesh section 130 is disposed between each of the first hair parting channel 140 and the second hair parting channel 145. At least a portion of the second mesh section 130 is disposed between each of the second hair parting channel 145 and the third hair parting channel 150. The second mesh section 130 contacts at least a portion of the first hair parting channel 140 and the third hair parting channel 150. The second mesh section 130 contacts the second hair parting channel 145 on three sides.

The third mesh section 135 is constructed of hand-tied nylon, silk, or cotton lace, or other suitable material. A right-side portion of the third mesh section 135 is disposed between the first hair parting channel 140 and the side region 120. A left-side portion of the third mesh section 135 is disposed between the third hair parting channel 150 and the side region 120.

Figure 6:
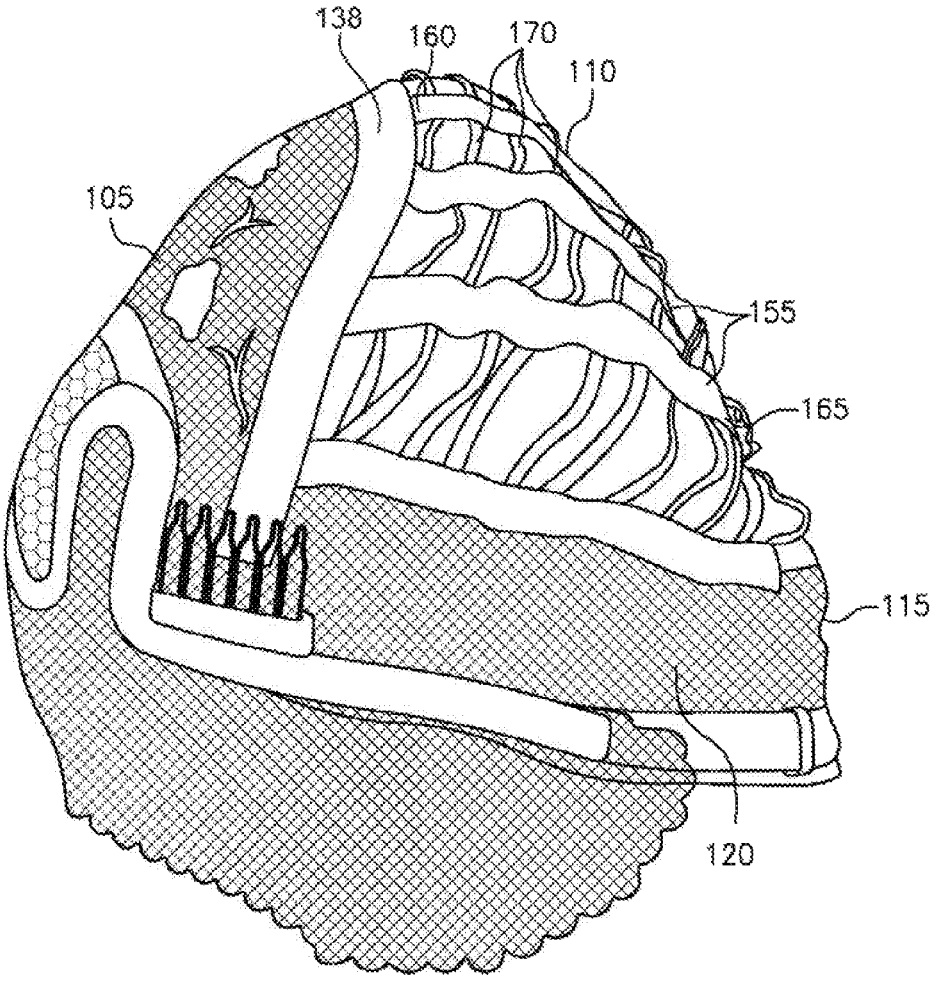
FIG. 6 illustrates a side view of the outer surface of the artificial hair apparatus.

FIG. 6 illustrates a side view of the artificial hair apparatus 100. Artificial hair disposed on the outer surface has been removed for illustrative purposes. The top region 110 is disposed adjacent to the front region 105 and is attached to the third mesh along a third connecting element 138. The top region 110 includes an inner top surface, an outer top surface, and multiple filaments 155. The filaments 155 extend across the top region 110 in a longitudinal direction and are constructed of a flexible elastic material that provides a secure and comfortable fit on a user's scalp. The filaments 155 include a first filament end 160 and a second filament end 165. The first filament end 160 is coupled to the front region 105 and the second filament end 165 is coupled to the rear region 115. The filaments 155 do not extend between the first hair parting channel 140 and the second hair parting channel 145 and do not extend between the second hair parting channel 145 and the third hair parting channel 150.

The artificial hair apparatus 100 includes multiple wefts of artificial hair 170. The wefts of artificial hair 170 extend across the artificial hair apparatus 100 in a transverse direction. The wefts of artificial hair 170 may extend through at least a portion of one of the front region 105, the top region 110, the rear region 115, and the side regions 120. Within the top region 110, the wefts of artificial hair 170 are coupled to the filaments 155. Coupling the wefts of artificial hair 170 to the filaments 155 in the top region 110 keeps the wefts of artificial hair 170 aligned in the proper position while also allowing the wefts of artificial hair 170 to conform to the user's scalp in a natural appearing and comfortable manner. The wefts of artificial hair 170 may extend through at least a portion of the front region 105 and at least a portion of one of the top region 110 and the side regions 120. The wefts of artificial hair 170 extend through at least a portion of the front region 105 and are attached to the first mesh section 125 in an area corresponding to a user's temple. The wefts of artificial hair 170 are attached to the first mesh section 125 by any suitable method, including by stitching, skin tape or glue tape.

Multiple side regions 120 are disposed adjacent to each of the front region 105, the top region 110 and the rear region 115. The side regions 120 include an inner side surface and an outer side surface. The inner front surface, the inner top surface, the inner rear surface and the inner side surfaces directly contact a user's scalp when the artificial hair apparatus 100 is disposed thereon. That is, there is no liner and no cap-insert inserted between the inner front surface, the inner top surface, the inner rear surface and the inner side surfaces of the artificial hair apparatus 100 and a user's scalp.

Figure 7:
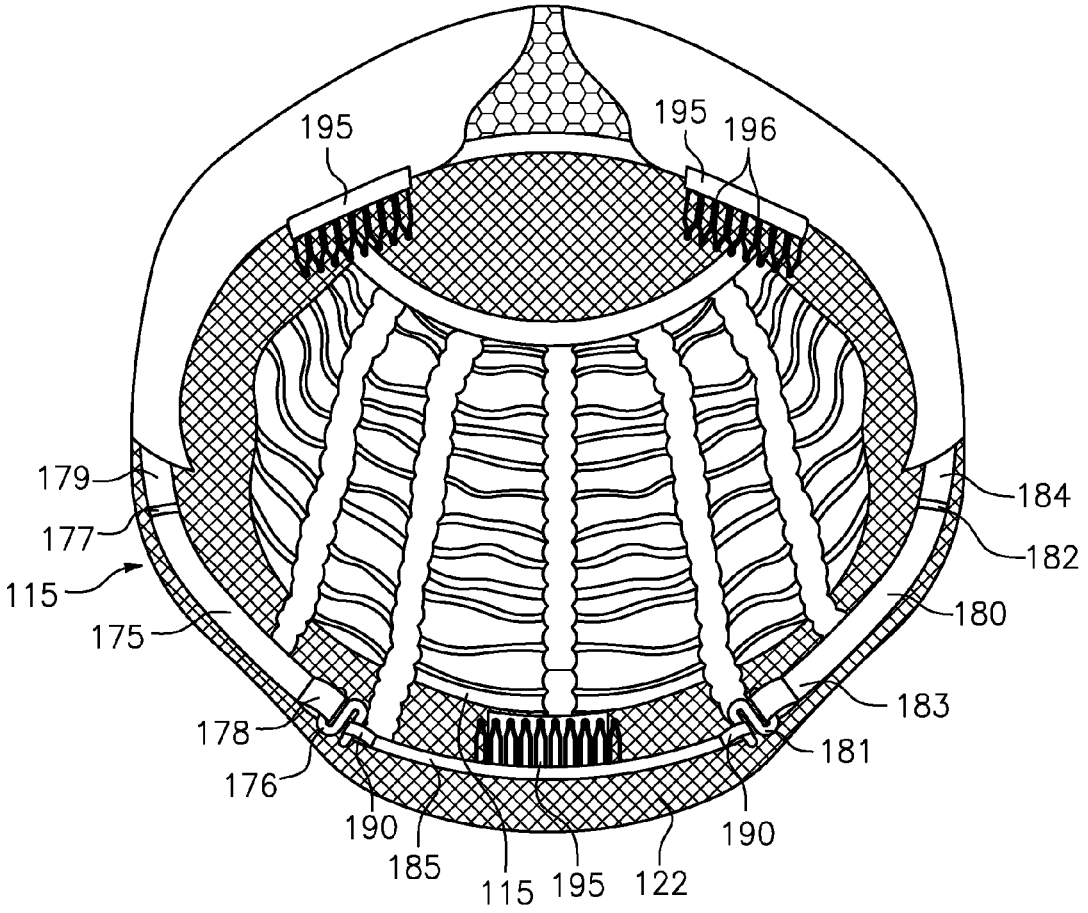
FIG. 7 illustrates a bottom view of an inner surface of the artificial hair apparatus.

FIG. 7 illustrates a bottom view of the artificial hair apparatus 100. The rear region 115 is disposed adjacent to the top region 110. The rear region 115 includes an inner rear surface and an outer rear surface. The rear region 115 includes a first adjustment member 175, a second adjustment member 180, and an adjustment hook receiving member 185. The first adjustment member 175 includes a first adjustment hook 176, a first alignment loop 177, a distal end 178 and a proximal end 179. The first adjustment member 175 is constructed of a flexible elastic material. The first adjustment hook 176 is coupled to the distal end 178 of the first adjustment member 175. The first adjustment member 175 extends along an inner surface of the circumferential edge region 122. The proximal end 179 of the first adjustment member 175 is coupled to the circumferential edge region 122 in the side region 120. The first adjustment member 175 is rigidly secured to the circumferential edge region 122 by, for example, stitching. The first alignment loop 177 is coupled to the circumferential edge region 122 and maintains alignment of the first adjustment member 175 along the circumferential edge region 122 such that the first adjustment member 175 does not shift away from the circumferential edge region 122.

The second adjustment member 180 includes a second adjustment hook 181, a second alignment loop 182, a distal end 183 and a proximal end 184. The second adjustment member 180 is configured as described above with respect to the first adjustment member 175.

The adjustment hook receiving member 185 includes multiple hook receiving loops 190. The adjustment hook receiving member 185 extends along the interior surface of the circumferential edge region 122 of the rear region 115. The adjustment hook receiving member 185 is constructed of a flexible inelastic material. In order to adjust the fit of the artificial hair apparatus 100, a user inserts the first adjustment hook 176 and the second adjustment hook 181 into the appropriate hook receiving loop 190. The circumferential edge region 122 thus may be contracted or expanded to correspond to the circumference of the user's head, providing a comfortable and secure fit.

The artificial hair apparatus 100 includes multiple comb members 195. The comb members 195 include tines 196 and are disposed adjacent to the circumferential edge region 122. The tines 196 insert into a user's natural hair, securing the artificial hair apparatus 100 in place on a user's scalp. First and second comb members of the comb members 195 are disposed overlapping the front region 105 and the side regions 120. The first and second comb members may overlap the side regions 120 and the third mesh section 135.

The first and second comb members may be disposed entirely in the side regions 120. A third comb member of the comb members 195 is disposed in the rear region 115 adjacent to the adjustment hook receiving member 185. The comb members 195 may be disposed at any position on the inner surface of the front region 105, the rear region 115 or the side regions 120.

A method of manufacturing the artificial hair apparatus 100 is also provided. The method includes assembling the artificial hair apparatus 100 as described above.

While embodiments of the invention have been shown and described with reference to certain embodiments thereof, it will be understood by those skilled in the art that various changes in form and details may be made therein without departing from the spirit and scope of the invention as defined by the appended claims and equivalents thereof.

What is claimed is:

1. An artificial hair apparatus comprising:

a front region comprising a first mesh section defining an anterior-most portion of the front region, a second mesh section and a third mesh section, where an anterior edge of the second mesh section is coupled to a posterior edge of the first mesh section along a first connecting element and an anterior edge of the third mesh section is coupled to a posterior edge of the second mesh section along a second connecting element, the first mesh section comprising a first hair parting channel a second hair parting channel provided in a central portion of the first mesh adjacent the first hair parting channel, and a third hair parting channel adjacent the second hair parting channel and opposite the first hair parting channel, wherein the first, second and third hair parting channels have an inverted U-shape opening anteriorly and providing an apex at posterior positions and portions of the second mesh section are provided between adjacent hair parting channels such that the first connecting element has an undulating central portion between the first and second mesh sections and opposing linear lateral portions extending posteriorly from opposing sides of the undulating central portion, and wherein the first hair parting channel has a first predetermined length, the second hair parting channel has a second predetermined length and the third hair parting channel has a third predetermined length where the first predetermined length and third predetermined length are greater than or less than the second predetermined length;

the second connecting element having opposing first and second ends coupled to the first connecting element at portions proximate the apex and lateral-most portions of the first and third hair parting channels, and the third mesh section having lateral portions directly adjacent the first and third hair parting channels and portions of the first connecting element corresponding thereto, the lateral portions of the third mesh being provided above corresponding sections of the linear lateral portions of the first connecting element;

a top region connected to the third mesh section of the front region along a third connecting element, the top region including a plurality of filaments extending posteriorly from the third connecting element;

a rear region adjacent to the top region where the plurality of filaments have a first end coupled to the third connecting element and an opposing second end coupled to the rear region;

a pair of side regions disposed between adjacent portions of the front region, the top region and the rear region; and wherein the plurality of filaments provide first and second lateral-most filaments on opposing sides of the top region, the first and second lateral-most filaments connect the top region to the side regions and a plurality of wefts of artificial hair extend transversely between the first and second lateral-most filaments and along the plurality of filaments.

2. The artificial hair apparatus according to claim 1, wherein additional wefts of artificial hair extend through at least a portion of the front region and at least a portion of one of the top region and side regions.

3. The artificial hair apparatus according to claim 1, wherein the first predetermined length and the third predetermined length are greater than the second predetermined length.

4. The artificial hair apparatus according to claim 1, wherein the first predetermined length and the third predetermined length are less than the second predetermined length.

5. The artificial hair apparatus according to claim 1, wherein the inner front surface of the front region directly contacts a user's scalp.

6. The artificial hair apparatus according to claim 1, wherein the top region has an inner top surface, the rear region has an inner rear surface and the side regions have an inner side surface, where the inner top surface, the inner rear surface, the inner to surface and the inner side surfaces are connected to form an interior surface of the hair apparatus and there is no liner between the interior surface of the hair apparatus and a user's scalp when the device is placed on the user.

7. The artificial hair apparatus according to claim 1, wherein artificial hair is coupled to the first mesh section such that at least a portion of the artificial hair coupled to the second hair parting channel overlaps the first hair parting channel and the third hair parting channel when the artificial hair is parted within the second hair parting channel.

8. The artificial hair apparatus according to claim 1, wherein at least one additional weft of artificial hair are is coupled to the first mesh section.

9. The artificial hair apparatus according to claim 8, wherein the at least one additional weft of artificial hair extends through at least a portion of the top region and the side regions.

10. The artificial hair apparatus according to claim 8, wherein the at least one additional weft of artificial hair is coupled to the first mesh section in an area corresponding to a user's temple.

* * * * *